US006886185B2

(12) United States Patent
Wren

(10) Patent No.: US 6,886,185 B2
(45) Date of Patent: May 3, 2005

(54) HOSIERY PROTECTIVE GLOVE

(76) Inventor: Estella Wren, 2084 Fox Hill La., Jackson, MS (US) 39272

( * ) Notice: Subject to any disclaimer, the term of this patent is extended or adjusted under 35 U.S.C. 154(b) by 7 days.

(21) Appl. No.: 10/198,225

(22) Filed: Jul. 19, 2002

(65) Prior Publication Data

US 2004/0010838 A1 Jan. 22, 2004

(51) Int. Cl.[7] ..... A41D 25/00
(52) U.S. Cl. ..... 2/158
(58) Field of Search ..... 2/16, 20, 160, 2/161.1, 161.6

(56) References Cited

U.S. PATENT DOCUMENTS 4,183,100 A * 1/1980 De Marco ..... 2/159
4,411,026 A * 10/1983 Secter ..... 2/158
5,343,566 A * 9/1994 Solheim et al. ..... 2/169
5,774,895 A * 7/1998 Baldwin ..... 2/161.1

* cited by examiner

*Primary Examiner*—Katherine M Moran
(74) *Attorney, Agent, or Firm*—Charles F. Rye

(57) ABSTRACT

A protective glove is set forth. It is constructed to protect snag prone garments and especially hosiery. It is intended to be worn by a person donning or doffing such garments to protect those garments from rough skin, fingernails and jewelry on the hand or wrist that may be worn on either hand. It may also be worn by persons working with the delicate materials in industry. The glove is generally of a mitten configuration constructed from one or two pieces of a slick finish fabric or synthetic material and joined on the edges with a coating on the exterior side of the pieces except on the finger and thumb tip area which gives greater grip control without snagging the garments. The coating provides a non-snagging gripping area to allow the user to control the garment especially while donning while having the slick fingertip and thumb tip to allow a smoothing action to prevent folds and wrinkles.

1 Claim, 1 Drawing Sheet

HOSIERY PROTECTIVE GLOVE

DESCRIPTION OF PRIOR ART

Figure 1:
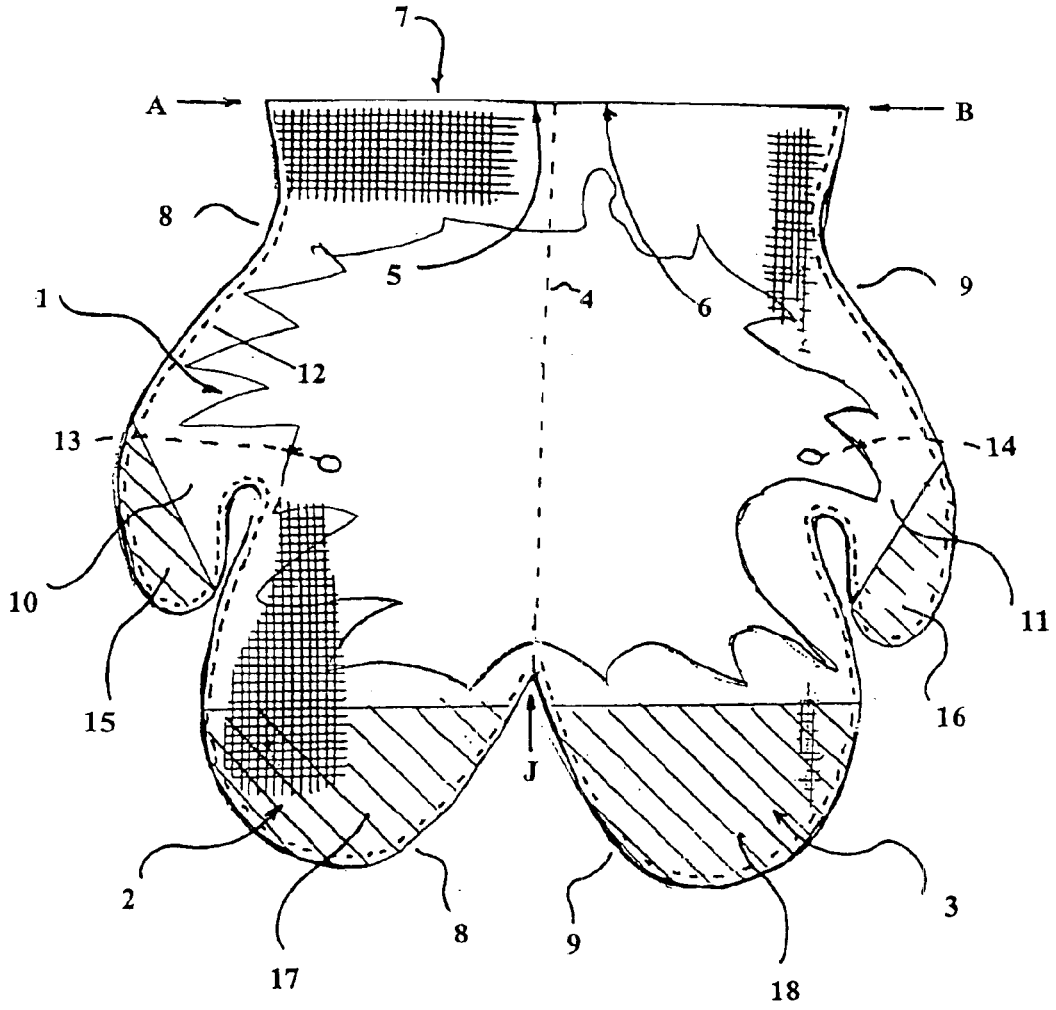

Gloves are a well known and in a crowded prior art section. That crowding points to the fact that many specializations of the basic concept to protect the wearer or protect what the wearer is handling have been recognized as innovative.

Prior art specifically for the protection of hosiery was claimed as early as 1939 in an U.S. Pat. No. 2,269,048 issued to Wright. Wright utilized a stylish construction of fabric sewn into a pocket for the fingers that was held in position on the hand by a strap looped around the hand with a thumb pocket on the end. Stebic claimed a Transparent Glove and generally preferred the use of synthetics which could be fabricated by heat sealing the seams, sewing or molding and the shape would accommodate jewelry in U.S. Pat. No. 2,670,473 issued in 1956. Wolfberg added to the art with claims for a design of the junction between the finger portions which was based on forming a radius instead of a sharp V to allow greater flexibility and cited use of nylon for lightweight construction in U.S. Pat. No. 4,534,066 issued in 1988. In U.S. Pat. No. 5,708,980 issued in 1998 to LaManna introduced the feature of intentionally creating ridges between the thumb and index finger with the seams to give a gripping means to control the garment as it is being donned. DePrado describes the use of seamless fingertip portions fabricated from woven fabric in U.S. Pat. No. 6,029,275. Other relevant prior art describes specific adaptations for specific uses and the basic construction of a glove for any purpose.

BACKGROUND OF THE INVENTION

The prior art describes several innovations to the basic hand coverings used to protect shear fabrics that tend to be used in hosiery while the wearer is donning them. However, there are several features of the present invention, which are not described in those patents.

The present invention generally comprises two pieces joined together except at the wrist portion or it can be cut as one piece with a common fold line generally opposite the thumb portion and then joined together except at the wrist portion. Joining may be by heat sealing, gluing, sewing or any means that will join the edges to make seams. The material may be woven, non-directional woven or uniform sheet. The structure may be molded by either dipping or hollow cavity to form a one-piece synthetic glove. The material may be natural or synthetic filament woven or non-directional woven or from synthetic sheet.

The pieces are the same shape allowing a single shape cutout or if a coating is pre applied the pieces are mirror images. The preferred embodiment is a mitten with or without a thumb stall. The resulting mitten will fit either hand. The size and shape of a mitten will accommodate jewelry and wearers who are affected with arthritis or other problems that affect shape and mobility of the digits. The finger end and thumb end, it present, portion of the mitten should be slick to allow the hosiery to be smoothed out without snags. However there is a need for to pull on garment sections as it is being donned and to control the folded or rolled portion of the garment that is held in the hand. The grip needed is supplied by a coating on the mitten that will not snag but has a higher coefficient of friction that the base fabric or synthetic sheet material. The coating having pigment coloration for printing of advertising and decorative images may have the physical properties of ink for application of decorative or advertising nature. The coating would generally be applied to the material of choice before cutting so that it may be done in a most economical manner in sheet or roll form similar to printing. With automated machinery for cutting the indexing would not present a problem and the designs can be such to allow some out of register condition.

The gloves produced by cutting rolled stock may have the gripping coating applied on the roll stock in a printing type operation which will require that a mirror image side be cut so that the gripping material is on the exterior of both pieces of the glove after the pieces are joined. The edge joining may be by sewing, gluing or heat fusing depending on the base material selected for the glove. The gripping material may simply be rubberized ink commonly used in silk screen printing for items such as T-shirts or a custom formulation by experimentation with available polymers.

DESCRIPTION OF THE DRAWING THAT IS THE PREFERRED EMBODIMENT

FIG. 1 shows a blank of material 1 which first portion 2 and second portion 3 form a siamese pattern about mirror line 4. First portion 2 and second portion 3 have respective wrist edges 5, 6 which cooperatively form the wrist opening 7. First portion 2 forms the palm side of the mitten and second portion 3 forms the opposite back of hand side when worn on the left hand and the respective opposite sides when worn on the right hand.

The first portion 2 has a joining edge 8 which extends from point A at the outward end of wrist edge 5 to the juncture J with the second portion 3. The second portion 3 has a joining edge 9 which extends from point B at the outward end of wrist edge 6 to the juncture J with the first portion 2.

The first portion 2 has a radially projecting thumb portion 10 which extends laterally form the first portion in a slightly declining disposition from wrist edge 5. The second portion 3 has a radially projecting thumb portion 11 which extends laterally from the second portion in a slight declining disposition from wrist edge 6. Edge 8 of the first portion 2 curves and extends at a relatively shallow angle from point A at the wrist edge 5 to join the thumb portion 10. Edge 9 of the second portion 3 curves and extends at a relatively shallow angle from point B at the wrist edge 6 to join the thumb portion 11. Edge 8 continues from thumb portion 10 to juncture J to form finger portion 17. Edge 9 continues from thumb portion 11 to juncture J to form finger portion 18.

Coated areas 13 and 14 are coated with a gripping material that has a higher coefficient of friction that blank of material 1. The gripping material should not be applied to the thumb tips 15, 16 or finger tips 17, 18.

In order to from the mitten, the blank of material 1 is folded along mirror image line 4 and joining commences from wrist opening 7 proximate where A and B overlap one another to juncture J. The joining extends all along the perimetral edge of the overlapped portions as shown in dotted area 12. The joining method is appropriate to the material and manufacturing method used. Examples would include sewing, gluing or heat sealing. After joining has been completed, the mitten is folded inside-out to produce the completed mitten which may be worn on either hand.

The embodiment described is exemplary and not intended to limit the variations of design and materials now available and materials developed in the future and uses that are discemable to those skilled in the art.

I claim:

1. A glove for covering the hand of the wearer that will accommodate jewelry worn by the user and low mobility or malformity of the digits to protect garments made of delicate snag prone materials while donning or doffing the garments, said glove made from slick finish cloth or synthetic material having a first side and a second side, comprising:

a first piece comprising;
- a palm section,
- a finger section,
- a thumb section; and a second piece comprising;
- a mirror image of the profile of the first piece of the same material;

a coating applied to one side of the first and one side of the second piece providing a gripping means on the exterior of the glove, said coating comprising;
- a material with a coefficient of friction higher than the glove material and having physical properties allowing application by silk screen methods, flexibility and adhesion to fabric, and
- having pigment coloration for printing of advertising and decorative images, and
- applied in manner to avoiding putting coating on the finger and thumb tip area;

said first and second piece joined at the edges to fit said hand so that the coating is exposed on the exterior of the glove.

* * * * *